United States Patent [19]

Borisuck et al.

[11] 4,193,155

[45] Mar. 18, 1980

[54] ANVIL FOR OUTSOLE SLITTING

[75] Inventors: John F. Borisuck, Naugatuck; William L. Coviello, Waterbury; Gary W. Sheedy, Naugatuck, all of Conn.

[73] Assignee: Uniroyal, Inc., New York, N.Y.

[21] Appl. No.: 853,936

[22] Filed: Nov. 22, 1977

[51] Int. Cl.[2] ..... A43D 43/04; B26D 7/20

[52] U.S. Cl. ..... 12/40; 12/146 BR; 83/658

[58] Field of Search ..... 12/41, 2, 146 BR, 146 B, 12/40, 18, 9, 27; 83/658

[56] References Cited

U.S. PATENT DOCUMENTS

| | | | |
|---|---|---|---|
| 520,709 | 5/1894 | Scott | 12/40 |
| 2,284,307 | 5/1942 | Sperry | 12/146 BR |
| 2,689,609 | 9/1954 | Butler | 83/658 |
| 3,089,164 | 5/1963 | Meserve | 12/40 |

*Primary Examiner*—Patrick D. Lawson
*Attorney, Agent, or Firm*—Steven H. Bazerman

[57] ABSTRACT

An anvil for supporting an outsole based upon an elastomeric compound, the outsole having a heel portion of greater thickness than the sole portion, during a process of imparting a multiplicity of slits to the outer surface of the heel and sole portions of said outsole. The anvil has a sole portion extending to a greater height than the heel portion of the anvil, whereby the multiplicity of slits may be imparted to the heel and sole portions of the outsole by a single reciprocating cutting blade in one continuous operation without removing the outsole from the anvil or changing the position of the outsole on the anvil. A method of imparting the multiplicity of slits to the outsole is also provided.

7 Claims, 7 Drawing Figures

ANVIL FOR OUTSOLE SLITTING

BACKGROUND OF THE INVENTION

The instant invention relates to footwear outsoles based upon an elastomeric compound, and more particularly to an anvil for supporting such an outsole during a process of imparting a multiplicity of slits to the outer surface of the heel and sole portions of the outsole, and to a method of imparting the slits.

A person walking over a smooth surface such as stairways, floors, stone or other pavings, or upon the decks of boats, particularly when these surfaces are wet, has a tendency to slip when he is wearing a shoe having a smooth rubber-like sole (outsole). This tendency to slip is caused by a film of water between the sole and the surface which is not squeezed out by the pressure of the foot. Accordingly, smooth rubber-like outsoles have been provided with a multiplicity of slits running transverse of the outsole. See U.S. Pat. No. 2,206,860, assigned to the assignee of the instant invention. The slits from a multiplicity of narrow sections extending in wavy lines across the outsole which increase the flexibility of the outsole, especially when the outsole is under pressure tending to cause the shoe to slip, whereby the section corners tilt upwardly and wipe the surface upon which the shoe rests dry to give the shoe a firm and secure grip upon this dry surface. Thus, relative movement between the shoe and surface is prevented when the pressures of walking generate a tendency to slip.

The multiplicity of slits are conventionally cut now by placing the outsole upside down on a flat anvil and advancing the anvil lengthwise underneath a single cutting blade which reciprocates against the outsole to a predetermined depth as the outsole is advanced. See, for example, U.S. Pat. No. 2,284,307, assigned to the assignee of the instant invention. Since the blade can be set to only one cutting depth, and the heel and sole of an outsole are of different heights, the cutting procedure is performed in two separate operations, usually on two different machines, so that the outsole has to be handled twice for the two independent operations.

Accordingly the instant invention provides a novel method and anvil so that the elastomeric outsole can be cut in one continuous operation with one blade depth setting.

SUMMARY OF THE INVENTION

The instant invention provides an anvil for supporting an outsole based upon an elastomeric compound, the outsole having a heel portion of greater thickness than the sole portion, during a process of imparting a multiplicity of slits to the outer surface of the heel and sole portions of the outsole. The anvil has a sole portion extending to a greater height than the heel portion of the anvil, whereby the multiplicity of slits may be imparted to the heel and sole portions of the outsole by a single reciprocating cutting blade in one continuous operation without removing the outsole from the anvil or changing the position of the outsole on the anvil.

The instant invention also provides a method of imparting a multiplicity of slits to the outer surface of the heel and sole portions of an outsole based upon an elastomeric compound, wherein the heel portion of the outsole is thicker than the sole portion of the outsole. The method comprises placing the outsole upside down on an anvil having a sole portion and a heel portion, said anvil sole portion extending to a greater height than the anvil heel portion, and advancing the anvil relatively lengthwise underneath a single cutting blade as said cutting blade reciprocates against the outsole to a predetermined depth, whereby the heel and sole portions of the outsole are cut in one continuous operation with one blade depth setting.

BRIEF DESCRIPTION OF THE DRAWINGS

FIG. 6 is a sectional view taken on the vertical plane indicated by the line 6—6 in FIG. 4;

DESCRIPTION OF THE PREFERRED EMBODIMENT

Figure 1:
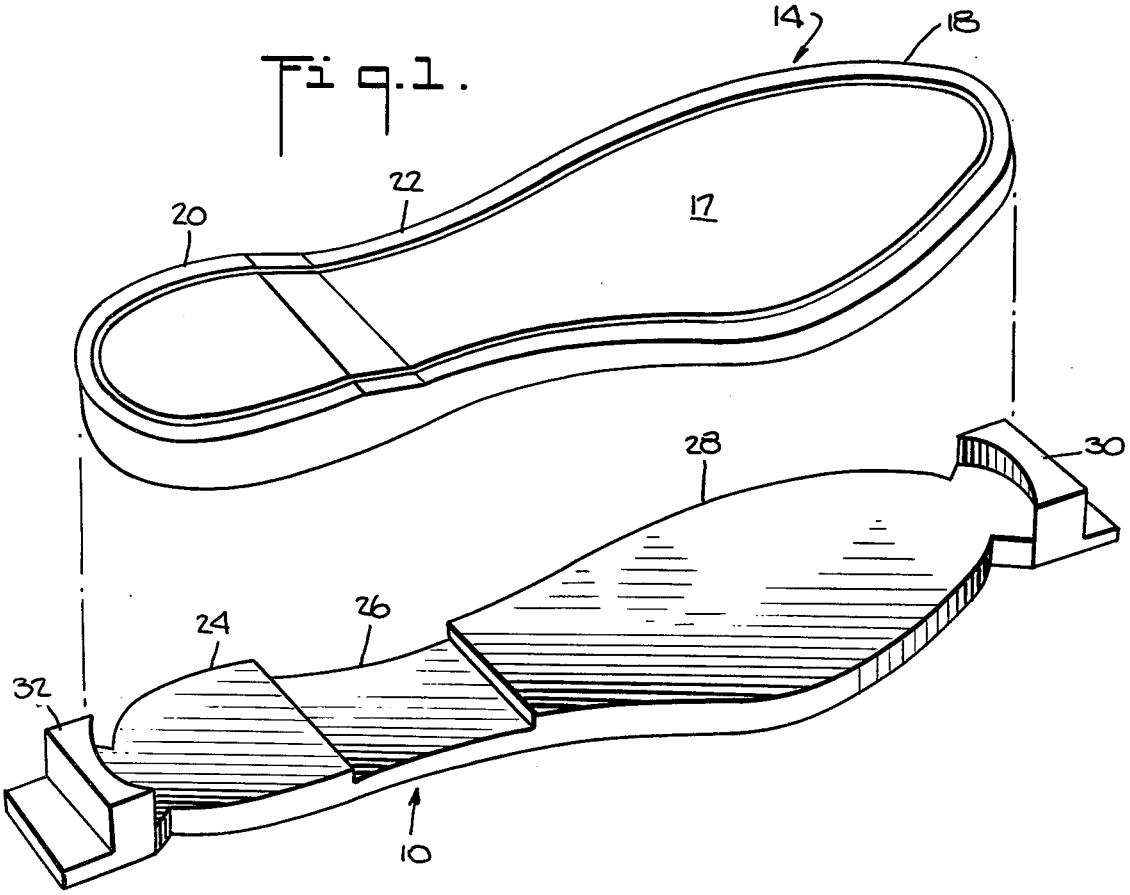
FIG. 1 is an exploded, perspective view of the anvil of the instant invention and an uncut outsole to be supported thereon.

For purposes of this specification and claims, the term elastomeric compound includes, but is not limited to, compounds based upon natural rubbers and synthetic elastomers.

In describing the preferred embodiment of the instant invention, reference is made to the drawings, wherein an anvil generally designated 10 is secured to a horizontally reciprocating base 12 (see FIG. 2) and supports an elastomeric outsole 14 situated upside down on the anvil 10. Located above the outsole 14 is a cutting blade 16 which reciprocates vertically against the outsole 14 to a predetermined depth as the outsole 14 is advanced lengthwise by the anvil 10, to impart a multiplicity of slits 15 to the outer surface 17 of the outsole 14.

Figure 3:
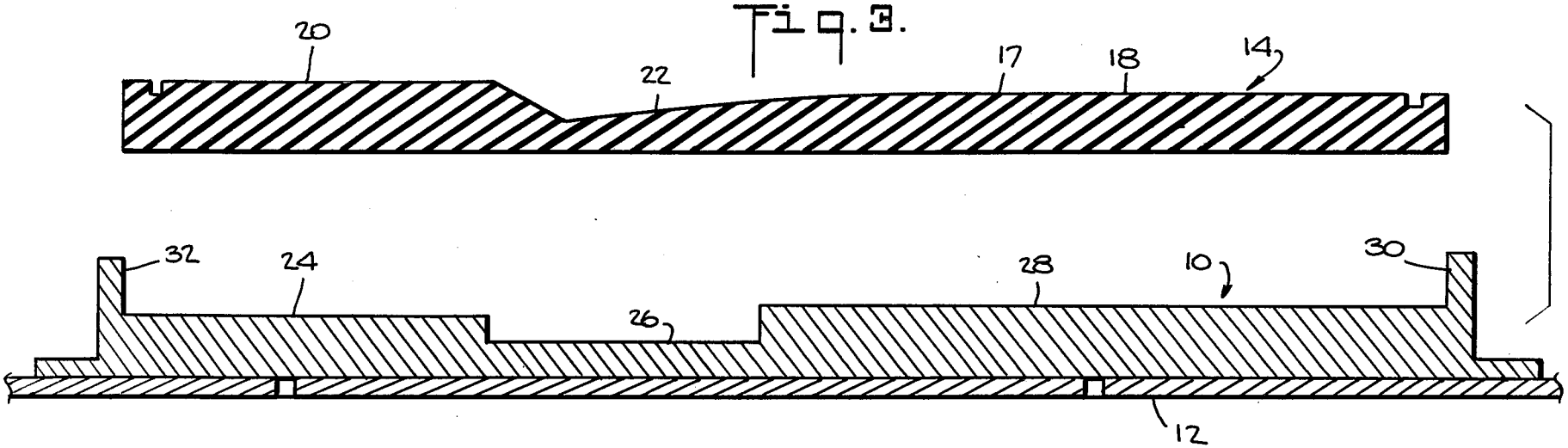
FIG. 3 is an enlarged, vertical lengthwise sectional view of the anvil and outsole shown in FIG. 1.
Figure 4:
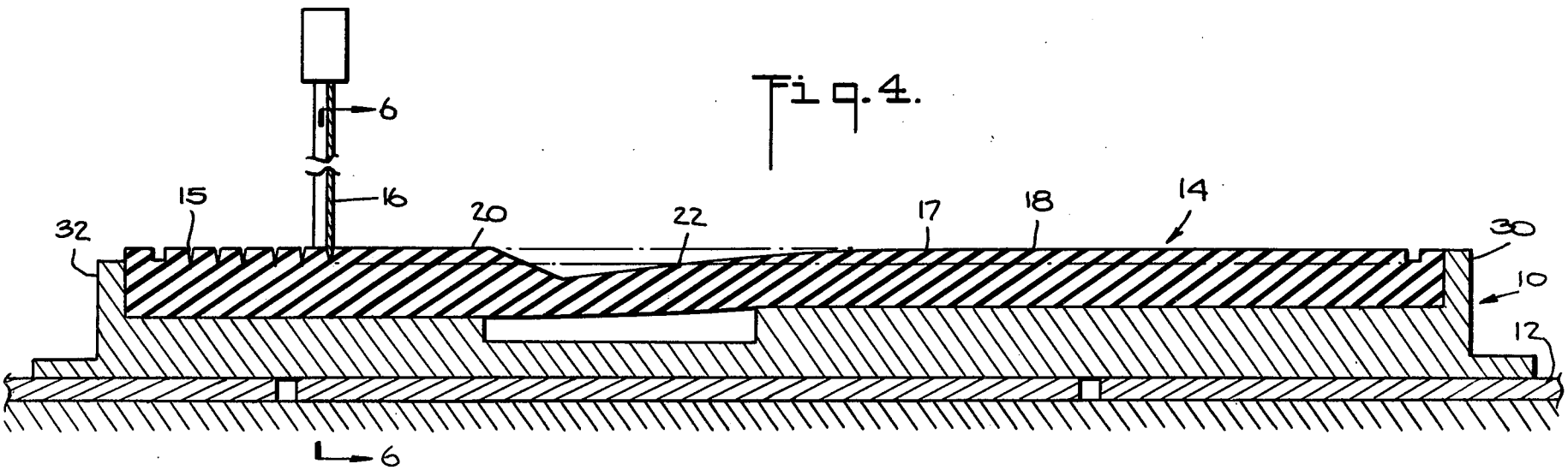
FIG. 4 is similar to FIG. 3 except that it shows the outsole being slit by the cutting blade as seen in FIG. 2.
Figure 7:
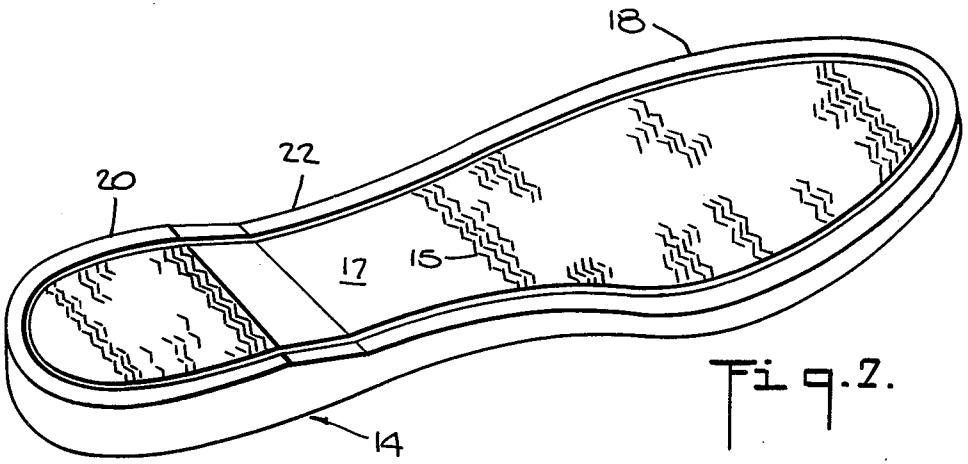
FIG. 7 is a perspective view of the outsole upside down after it has been cut.
Figure 8:
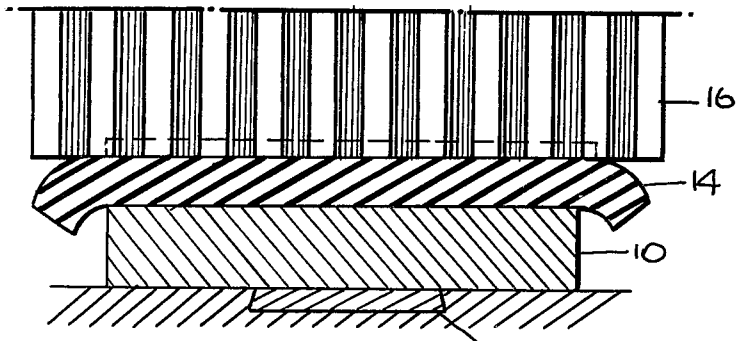
Figure 5:
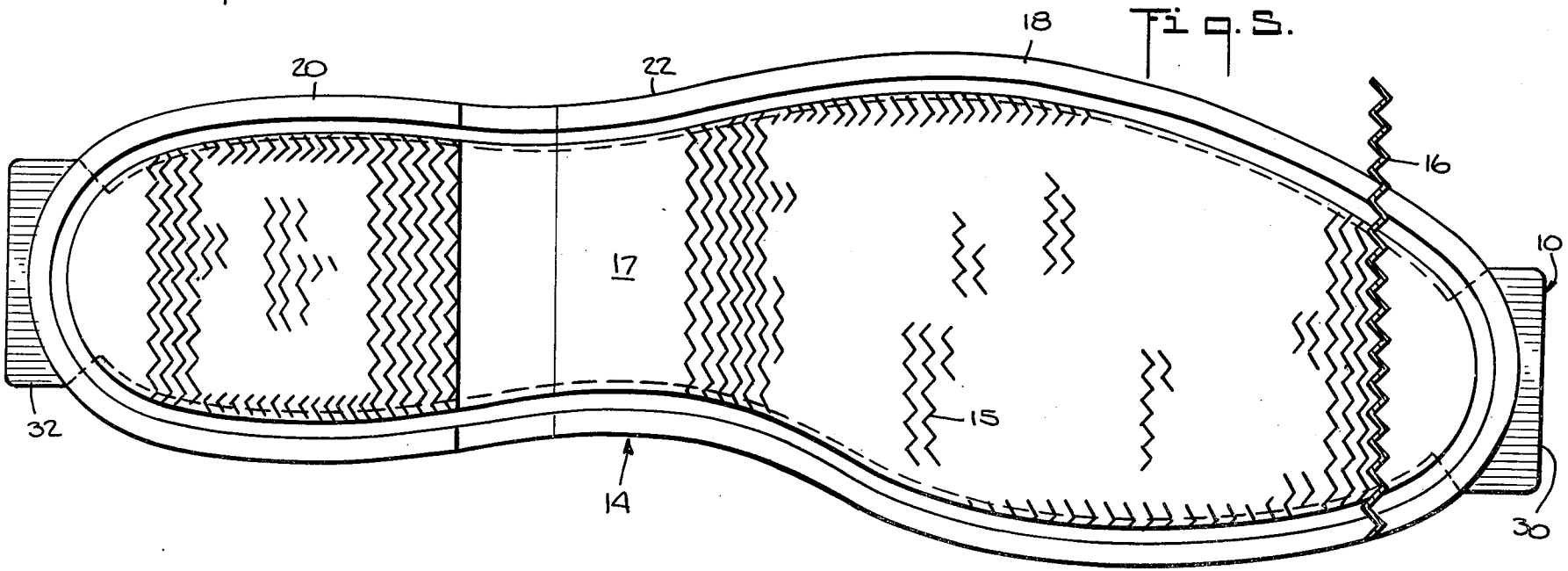
FIG. 5 is an enlarged, top plan view of the outsole and blade after the outsole has been cut.

As best seen in FIG. 3, the outsole 14 has a sole portion 18, a heel portion 20 and a shank portion 22, the heel portion 20 being the thickest portion of the outsole 14 and the shank portion 22 being the thinnest portion of the outsole 14. To compensate for the differential thicknesses in the outsole 14, the anvil 10 is provided with a heel portion 24, a heel shank portion 26 and a sole portion 28, wherein the sole portion 28 of the anvil 10 extends to a greater height than the heel portion 24 of the anvil 10. In order for the blade 16 to avoid cutting the shank portion 22 of the outsole 14, the shank portion 26 of the anvil 10 is recessed.

Figure 2:
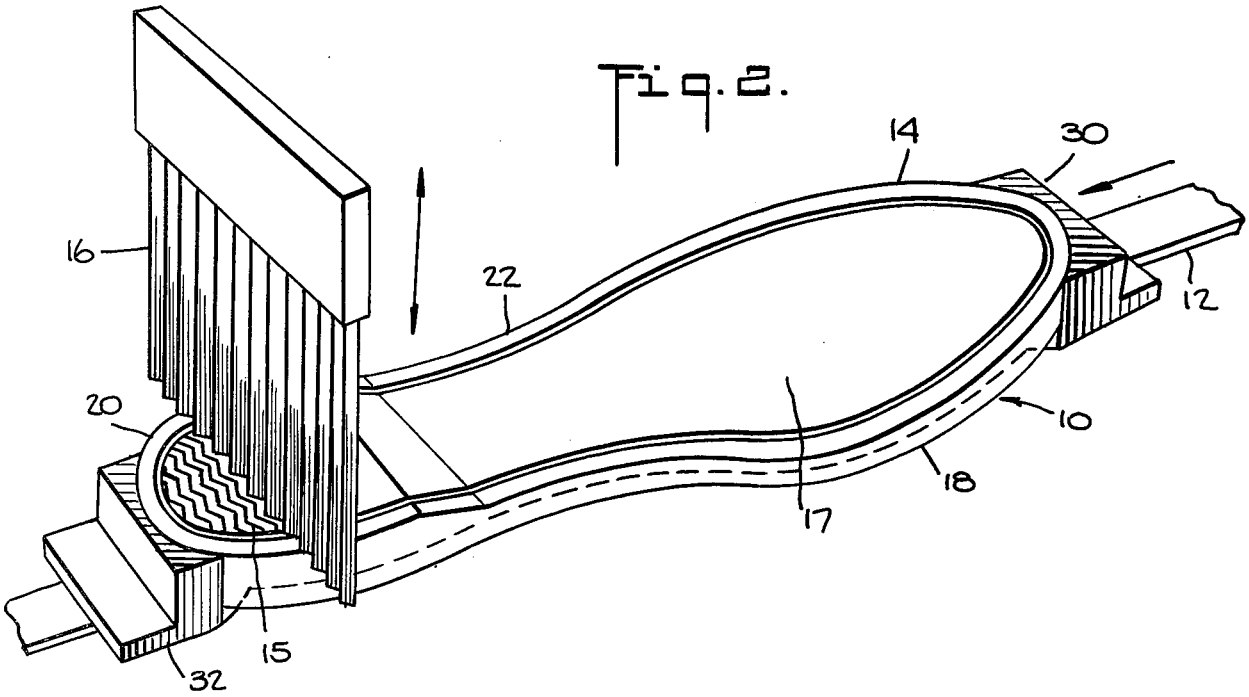
FIG. 2 is a perspective view of the anvil and outsole shown in FIG. 1 as the outsole is being slit by a cutting blade.

The outsole 14 typically consists of solid rubber, expanded rubber compound (cellocrepe) or thermoplastic rubber compounds. As best seen in FIGS. 2 and 6, the periphery of the anvil 10 is slightly smaller and similar to the outside edge configuration of the outsole 14. The anvil 10 includes a toe stop 30 at one end and a heel stop 32 at the other end to contain the outsole 14 during the cutting operation. The anvil 10 may be made from wood, hard plastics or metals. Each outsole size will require its own anvil since the lengths of sole, heel and shank portion vary with size in a predetermined manner.

The following table illustrates preferred anvil portion heights for an outsole having the thicknesses indicated, all dimensions being in inches:

| | anvil | outsole |
|---|---|---|
| sole | .500–.495 | .300–.320 |
| heel | .450–.445 | .450–.470 |
| shank | .250 | .225–.245 |

The differential in height between the sole and heel portions on the anvil 10 enables the outsole 14 with a heel and sole of different thickness to be cut continuously to a specified depth with one blade depth setting. Based on the above table, the blade 16 would cut the sole and heel portions 18 and 20 respectively to a uniform depth, although the heel portion 20 may have a slightly deeper slit, depending on the resiliency of the outsole elastomeric compound, since the combined thickness of the anvil and outsole heel portions exceeds the combined thickness of the anvil and outsole sole portions. Since the shank portion 26 of the anvil 10 is recessed, the shank portion 22 of the outsole 14 is not cut when the blade passes over said outsole shank portion 22, which merely flexes into the recess over the anvil shank portion 26. Because the outsole 14 flexes into the recess above the anvil shank portion 26, the outsole 14 is slightly longer than the length of the anvil 10 between the toe and heel stops 30 and 32 respectively. Obviously, the height dimensions of the different anvil portions can be altered to suit any varying degree of hardness ordurometer of outsole compound relative to the thickness of the outsole. Also, the relative lengthwise movement of the anvil 10 with respect to the blade 16 may be achieved by movement of the blade 16 relative to the anvil 10.

What is claimed is:

1. An anvil for supporting an outsole formed from an elastomeric compound having a heel portion thicker than the sole portion during a process of imparting a multiplicity of slits to the outer surface of the heel and sole portions of said outsole, said anvil being substantially flat over most of its length, and having a sole portion and a heel portion, the sole portion extending to a greater height than the heel portion of the anvil, whereby the multiplicity of slits may be imparted to said outsole heel and sole portions by a single reciprocating cutting blade in one continuous operation without removing the outsole from the anvil or changing the position of the outsole on said anvil.

2. The anvil of claim 1, wherein the anvil includes a shank portion which is shallower than either the heel or sole portion of the anvil.

3. The anvil of claim 2, wherein the anvil includes a toe stop secured to the end of the sole portion and a heel stop secured to the end of the heel portion.

4. The anvil of claim 3, wherein the anvil is made from metal.

5. The anvil of claim 3, wherein the sole portion is about 0.50 inch high, the heel portion is about 0.45 inch high, and the shank portion is about 0.25 inch high.

6. The anvil of claim 3, wherein the sole portion of the anvil is about 0.05 inch higher than the heel portion of the anvil.

7. The anvil of claim 6, wherein the sole portion of the anvil is about 0.25 inch higher than the shank portion of the anvil.

* * * * *